United States Patent [19]

Dwan

[11] 4,220,480

[45] Sep. 2, 1980

[54] PROCESS FOR VACUUM PYROLYSIS REMOVAL OF POLYMERS FROM VARIOUS OBJECTS

[75] Inventor: Thomas S. Dwan, Wakefield, Mass.

[73] Assignee: Beringer Co., Inc., Marblehead, Mass.

[21] Appl. No.: 942,954

[22] Filed: Sep. 18, 1978

Related U.S. Application Data

[63] Continuation of Ser. No. 803,425, Jun. 6, 1977, abandoned.

[51] Int. Cl.[2] ..... B08B 7/04

[52] U.S. Cl. ..... 134/5; 134/19; 134/21; 134/38

[58] Field of Search ..... 134/5, 19, 21, 38, 104; 260/2.3

[56] References Cited

U.S. PATENT DOCUMENTS

| | | | |
|---|---|---|---|
| 81,164 | 8/1868 | Harmon et al. | 134/5 X |
| 3,374,117 | 3/1968 | Savage | 134/19 X |
| 3,448,509 | 6/1969 | O'Reilly | 134/19 X |
| 3,923,653 | 12/1975 | Lavins | 134/5 X |
| 4,057,438 | 11/1977 | Mainord | 134/38 X |

OTHER PUBLICATIONS

Biklen, *SPE Journal,* "Now: Remove Plastic Deposits from Extruder Parts the Modern Way," vol. 29 (No. 7), 1973, pp. 25–27.

Barthelemy, "Vacuum Pyrolysis of Polymer v. Pollution" *SPE 33rd Tech. Conf.,* 1975, pp. 601–603.

*Primary Examiner*—Marc L. Caroff

*Attorney, Agent, or Firm*—Kenway & Jenney

[57] ABSTRACT

Polymeric organic compounds are pyrolyzed to remove them from objects by heating in a first vacuum chamber to render flowable such polymers as are fusible at a temperature below that at which appreciable degradation is initiated. The fused polymer drops by free fall from the first chamber to a second vacuum chamber through a conduit connecting the two without contacting any intervening structure. The second chamber is maintained at a substantially lower temperature, where the polymer resolidifies. Upon further heating, polymer remaining in the first chamber is volatilized and withdrawn from the chamber to a water mist scrubber where it is largely trapped. Remaining vapors in the scrubber are drawn through a vapor separator to a vent stack. After the combustible volatiles are removed from the first chamber, air is admitted into the chamber to oxidize any residual carbon ash, leaving only the inorganic residue which is easily removable from the objects or materials that were not affected by the pyrolysis action.

2 Claims, 1 Drawing Figure

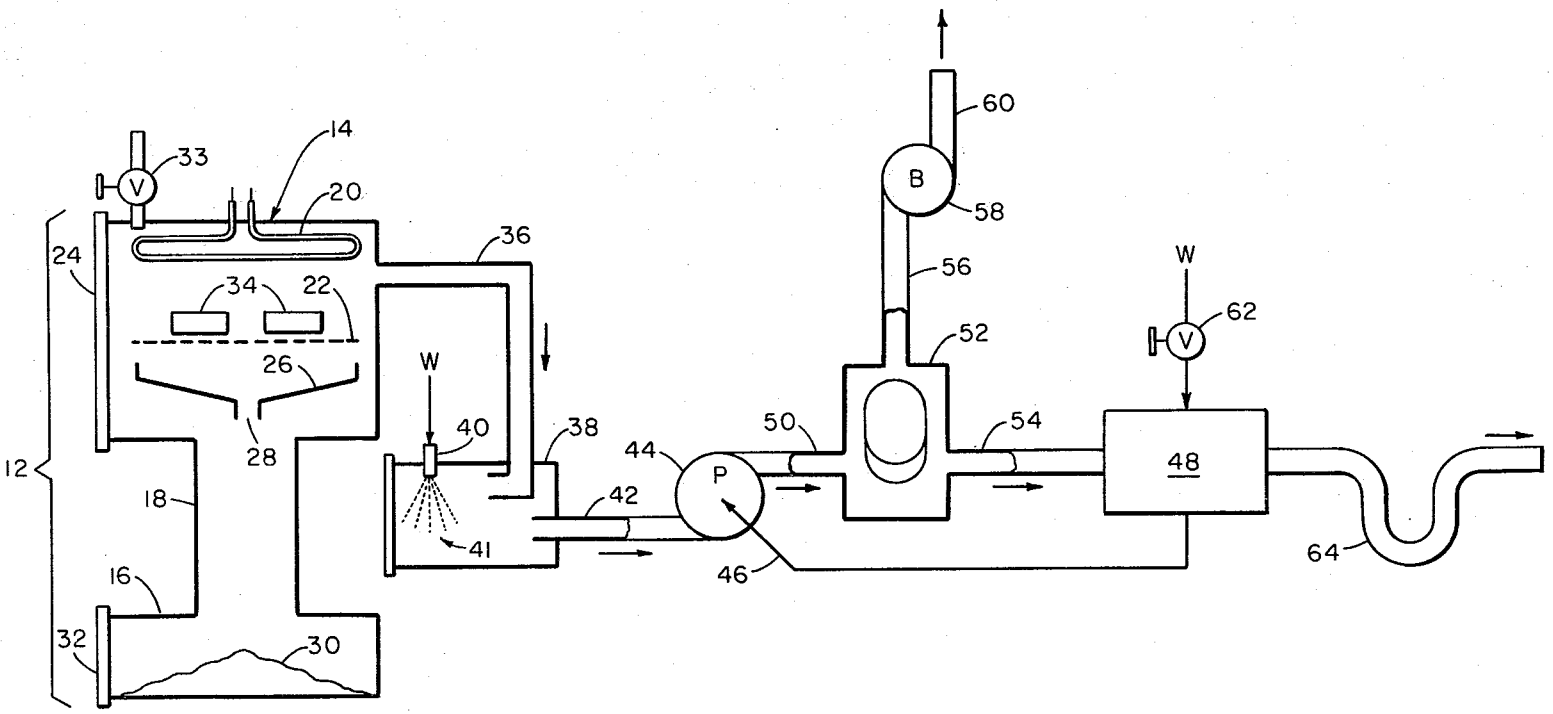
12
14
16
18
20
22
24
26
28
30
32
33
34
36
38
40
41
42
44
46
48
50
52
54
56
58
60
62
64
W
W
B
P
V
V

PROCESS FOR VACUUM PYROLYSIS REMOVAL OF POLYMERS FROM VARIOUS OBJECTS

This is a continuation of application Ser. No. 803,425, filed June 6, 1977, now abandoned.

BRIEF SUMMARY OF THE INVENTION

This invention relates generally to methods for pyrolytic separation of polymeric organic compounds from objects or substances that are substantially unaffected by the applied heat. Such methods are useful in the polymer related industries to remove a variety of plastics from such objects as dies, blow molding heads, breaker plates, screen packs and filters, spinnerettes, extruder screws, pumps, nozzles and other such tooling. The parts so cleaned may then be reused. The process is also useful for reclaiming metals by separation from such polymers, and for reclaiming certain constituents of the polymers.

More specifically, the invention relates to improvements in the fusing of such polymers as are flowable at temperatures below those at which appreciable degradation is initiated, and improvements in the removal of plastics having an ash of high carbon content after pyrolysis has removed the volatile constituents.

There are numerous methods for removal of deposits of plastic from metal parts. Except for the methods employing solvents, ultrasonic cleaning or a combination of these, the methods generally involve heating to a temperature usually in the range from 800 degrees to 900 degrees F. within which the plastic degrades. During degradation volatile constituents which are generally combustible are evolved, leaving a residue that is frequently composed largely of carbon. If oxygen is present oxidation occurs, leaving an inorganic dust or powder residuum.

Prior methods of cleaning include, for example, covering the parts with molten salts; or heating the parts in an oven in an atmosphere of air, inert gas or steam; or immersing the parts in a bed of heated aluminum oxide; or heating the parts with a blow torch or upon a hot plate. Each of these methods has one or more disadvantages such as the need for periodic replacement of salt or other medium of immersion, atmospheric contamination by smoke or vapor, lengthy time periods for completion of the cleaning, annealing or distortion of parts from which the plastic is to be removed, danger to operators from salt eruption, spillage or other hazards, residues such as salt or aluminum oxide left on parts requiring further cleaning operations, and limitations either to specific resins, to limited amounts of resin, or to the cleaning of parts that do not have complicated shapes.

Many of the foregoing disadvantages have been overcome by a particular process of vacuum pyrolysis described in an article by Don Biklen, entitled "Now: Remove Plastic Deposits From Extruder Parts the Modern Way," published in the SPE Journal for July, 1973, Volume 29, page 25. According to this method, plastic coated parts are placed in a chamber fitted with radiant heating elements and with a vacuum pump leading to a waste line. Under vacuum the parts are heated. When the temperature reaches 800 to 900 degrees F. the plastic decomposes, certain constituents vaporize and the vapors are pulled off through a condensate trap where most of the solids condense upon contact with water. Vapors and water leaving the trap enter the vacuum pump. The water and vapor move through the pump to a separator from which the water passes to a drain or recirculates to the vacuum pump and the vapor is exhausted to atmosphere through a vent stack either directly or through a gas-fired afterburner.

A refinement of this process also has been in use by the assignee of the present application, involving a second vacuum chamber or collection receptacle installed beneath the first vacuum chamber and in space communication therewith through a connecting pipe. The second chamber is maintained at a substantially lower temperature than the first chamber. Upon heating, certain plastics in the first chamber become flowable at higher temperatures and drop to a collection tray leading through the connecting pipe to the second chamber, where the temperature is low enough to cause resolidification. The second chamber has a collection pan and door for removal of the collected plastic. This refinement permits the retrieval of a substantial portion of the total plastic material without its pyrolysis.

However, in some instances difficulty has been experienced with this refinement because of the failure of the fused plastic to flow from the heated vacuum chamber quickly enough to prevent its degradation as the temperature rises. This difficulty has been caused primarily because of the viscous nature of the molten plastic which impedes its flow, in many instances blocking the connecting pipe. Attempts have been made to reduce this problem by surrounding the connecting pipe with a heater, but this expedient is only partially successful.

This invention comprises improvements upon the process described by Biklen and its later refinements, by facilitating the removal of fused polymer from the heated vacuum chamber so that it may be collected efficiently and resolidified with minimal or negligible degradation. Thereby, the remaining polymer that is subjected to pyrolysis comprises only a fraction of the total polymer to be separated from the contents of the heated chamber. Improvements are also made to the process of pyrolysis following the removal of the volatile comstituents, when the remaining ash is of high carbon content. By the latter improvements, the residuum, frequently comprising substantially only inorganic pigments or fillers, is a dust or powder that is easily cleaned from the parts.

BRIEF DESCRIPTION OF THE DRAWING

The drawing is a partially schematic representation of apparatus adapted to carry out the process of this invention in its preferred form and variations.

DETAILED DESCRIPTION

Referring to the drawing, the reference number 12 represents a chamber unit comprising a three-part vacuum enclosure. The parts comprise a first chamber 14, a second chamber or collection receptacle 16, and a connecting section 18 which is preferably but not necessarily a vertical pipe of substantial diameter as hereinafter further described. The first chamber is preferably lined with stainless steel, insulated and fitted with one or more electrically energized radiant heating elements 20, a heating control thermocouple (not shown), a rack 22, a door 24 for insertion or withdrawal of the rack, and a collection tray 26. The tray has a central opening or discharge point 28 located on the axis of the section 18 so that molten polymer flowing from the tray falls by free fall completely out of contact with the walls of the section 18 onto a mass 30 of congealed or resolidified polymer in the chamber 16.

The section 18 is of such dimensions and orientation as to isolate the second chamber 16 thermally from the first chamber 14 so that the temperature of the chamber 16 is substantially below that of the chamber 14. This permits solidification to occur immediately as the polymer reaches the chamber 16. The chamber 16 has a door 32 for removal of the resolidified polymer after the process is completed.

Preferably, the chamber 14 is arranged with means (not shown) for loading polymer-laden pieces 34 on the rack 22 externally of the chamber 14 and for inserting the loaded rack into the chamber. An air valve 33 is also provided for a purpose hereinafter described.

A pipe 36 leads to a condensate trap or water mist scrubber 38 having a nozzle 40 connected to a source of water and producing a water spray 41. The water spray impinges on the vapors passing to the trap 38 from the chamber 14.

A pipe 42 is connected from the trap 38 to a vacuum pump 44 of the water ring type. An arrow 46 represents a supply of water to the pump from a recirculation tank 48 described below.

A pipe 50 is connected from the pump 44 to a separator 52. The separator has a water trap that separates the water carrying trapped polymer particles from the remaining vapor, the water passing through a pipe 54 to the recirculation tank 48 and the vapor passing through a pipe 56 to a gas-fired afterburner 58, the exhuast of which leads to a stack 60. In many cases the afterburner can be omitted as the effluent is within the atmosphere safety limits of typical communities.

A source of makeup water is connected through a valve 62 to the recirculation tank 48. The tank 48 is of conventional construction and serves to filter out and retain the trapped polymer particles in the water, discharging clean water to the pump 44 as indicated by the arrow 46. Suitable means are provided for periodically cleaning out the tank 48. The valve 62 is opened to provide only the makeup water required to replace a corresponding amount of water discharged through a P-trap 64 to a drain. The rate of discharge is adjusted to maintain the temperature of the recirculated water at a value below 85 degrees F. Maintenance of the water temperature below the stated value has been found to improve the efficiency of the pump 44.

If desired, skimming devices and fine screens or other filters may be employed in the system, preferably within the closed loop between the pump 44 and the tank 48.

As an alternative, the system can also be operated by discharging the separator 52 directly to the drain, thus eliminating the recirculation tank 48, in situations where the illustrated arrangement is not required.

The apparatus described above is adapted for any of several selected modes of operation which are next described. The selected mode is dependent upon the type and quantity of plastic material to be subjected to pyrolysis. The types of plastics generally used differ in two important respects, namely, the property of becoming fusible at a temperature below that at which appreciable degradation occurs, and the presence of an ash of high carbon content following the evolution of substantially all of the volatile constituents. For example, vinyl and rubber compounds are not fusible to an extent rendering them flowable at temperatures below that at which these compounds begin to degrade. In contrast, most of the other compounds are flowable at temperatures below those at which they begin to degrade, for example polystyrenes, polyolefins, polycarbonates, nylons, polyesters and polypropylenes, to mention common examples. Some polymers including polyolefins and polystyrenes do not have an ash of high carbon content after the evolution of volatile components, while other polymers such as polyesters, nylons, vinyls, polycarbonates and rubber compounds do have such an ash.

In use, the above-described apparatus may be controlled manually but is preferably controlled in an automatic cycle by a timer (not shown) adjusted to accommodate the characteristics of the particular polymers and the quantities thereof to be removed from the parts 34. The cycle is generally of 60 to 90 minutes duration, but in some cases it can be longer. The following description is generalized to include the various types of plastics commonly used. In the case of particular plastics the duration of each step, the level of vacuum maintained and the temperatures of the respective chambers are appropriately adjusted for maximum efficiency, cleanliness of effluents and rapidity of polymer removal.

Polymer-laden or coated parts 34 are first placed in the chamber 14 on the rack 22, and the doors 24 and 32 are sealed. The air valve 33 is closed. The pump 44 is then turned on to evacuate the system comprising the entire enclosure 12, the pipe 36 and the trap 38. Typically, the vacuum is maintained at 25 to 27 inches of mercury. At the same time the radiant heating element 20 or a plurality of such heaters are energized to cause the temperature within the chamber 14 to increase.

At a given temperature, certain of the above-stated polymer types fuse and flow from the parts 34, dropping to the inclined collection tray 26 and draining therefrom through the opening 28. This material then drops through the section 18 to the substantially cooler chamber 16 where it resolidifies in the mass 30. The chambers 14 and 16 and the connecting section 18 are so arranged that the chamber 16 preferably does not exceed a maximum temperature of 150 degrees F. during the cycle, whereas the temperature of the chamber 14 rises substantially higher as hereinafter described. It will be noted that since the tray 26 is situated within the heated chamber 14, the fused polymer that falls to the tray remains at substantially the same temperature until it passes through and falls from the opening 28. After passing from the opening the polymer does not contact any wall surface of the connecting section 18 and falls freely by gravity through this section to the cooler chamber 16. The result is rapid elimination of the fused polymer that drops from the parts 34 from the chamber 14, thereby avoiding the clogging of pipes or passages and the possibility that this polymer will be retained within the chamber 14 long enough to begin to degrade as the temperature of that chamber continues to increase.

The heating element 20 continues to be energized and to increase the temperature within the chamber 14 until the polymer remaining on the parts 34 beings to degrade by evolution of its volatile components. This degradation is not accompanied by burning because of the lack of oxygen within the chamber. Ordinarily, the temperatures required to cause such vaporization are in the range between 800 degrees and 900 degrees F., although the apparatus is preferably designed for operating temperatures within the chamber 14 up to about 1,000 degrees F.

The vapors evolved from the parts 34 during degradation pass through the pipe 36 to the trap 38 where they are projected into the path of the water spray 41. Here, most of the solids entrained in the vapors are trapped in the water. The water laden with solids, combined with the remaining vapor, passes through the pump 44 to the separator 52. From the separator, substantially all of the vapors pass through the pipe 56 to the afterburner 58, where any combustible components may be burned. In practice, the afterburner 58 is usually not required because the vapors in the pipe 56 are sufficiently clean for exhausting directly to the atmosphere.

The water containing solids passes through the pipe 54 to the separator 48, which filters out substantially all of the solids and recirculates water to the pump 44. The rate of flow of water through the trap 64 substantially equals that through the nozzle 40 and makeup valve 62, and is controlled by the valve 62 to maintain the temperature of the recirculating water below approximately 85 degrees F.

After an interval of time, substantially all of the vaporizable constituents of the polymer, which are frequently combustible, are removed from the chamber 14 leaving an ash upon the parts 34. In certain cases this ash has a high carbon content. For example, the ash of polyesters is approximately 86 percent carbon. While maintaining the chamber 14 at a temperature in the range of 800 degrees to 900 degrees F. and continuing to operate the pump 44, the vacuum is gradually reduced to a lower value or zero by introduction of air through the valve 33 to react with the carbon, thereby producing carbon dioxide and carbon monoxide. To facilitate this reaction the air introduced through the valve 33 may be preheated, and means may be provided to distribute it uniformly over the parts 34. These gases are withdrawn through the pipe 36 to the trap 38. The remaining residue on the parts 34 after this combustion is completed is generally in the form of dust or powder and mostly comprises inorganic pigments and fillers. At this stage the heater 20 and the pump 44 are de-energized, and the door 24 may be opened to remove the parts 34.

It will be understood that the above-described step of introducing air through the valve 33 may be omitted in certain instances, for example where the polymer is a polyvinyl chloride compound and it is desired to avoid the release of chlorine gas by combustion.

The final cleanup of the parts 34 may be accomplished by any of the known techniques such as air-jet cleaning, wiping or bead dusting at low pressure with glass, woodflour, lime or soda particles.

Although the apparatus described above employs a three-part vacuum enclosure 12 including a vertical connecting pipe section 18, other forms of construction can be used to carry out the process. For example, a single enclosure may be provided with a heat baffle dividing the internal space into two regions, one above the other. The upper region may contain the rack, the inclined tray for molten polymer and the radiant heating means. The heat baffle may have an aperture through which the molten polymer falls by free fall to the lower, cooler region of the enclosure. The heat baffle may be provided with reflective surfaces to reflect the radiant heat upwardly toward the articles on the rack.

The process described above has been employed successfully to remove polymers from parts having complicated shapes. It has also accomplished the removal of polymers from parts without distorting them or materially changing their surface finish.

This process has been further demonstrated to be safe for workers, for waste water disposal and for control of atmospheric pollution.

I claim:

1. The process of removal of organic material coating an object, comprising the steps of evacuating air from a first space immediately surrounding the object, heating said space to cause the temperature thereof to rise into a first range sufficient to fuse said material but insufficient for substantial degradation thereof, said heating causing heat to penetrate said coating in a direction toward said object, whereby a portion of said material is non-degraded form falls from the object, while collecting said falling portion and concentrating and directing its flow by gravity to a drain located within said first space, said portion being permitted to fall from said drain through a conduit connecting said first space to a second space, said conduit being of sufficient orientation and dimensions to substantially thermally isolate said second space from said first space, said second space being maintained at a temperature permitting said portion to resolidify therein, said collected portion being directed to fall from the first space into the second space through the connecting conduit without contacting any intervening structure, and thereafter further heating said first space to cause the temperature thereof to rise into a second range between 800 degrees F. and 1,000 degrees F., said second range being sufficient to degrade the material remaining on the object including first withdrawing volatile products produced by said degradation from the first space to leave a resulting ash and thereafter introducing air into the first space while maintaining the temperature thereof within said second range, whereby carbon in said ash is combined with oxygen to produce gaseous oxides, including withdrawing said gaseous oxides from the first step to leave a substantially inorganic residue.

2. The process according to claim 1, further including trapping in water particulate matter carried by said volatile products of degradation as the latter are withdrawn from the first space.

* * * * *

UNITED STATES PATENT AND TRADEMARK OFFICE

CERTIFICATE OF CORRECTION

PATENT NO. : 4,220,480

DATED : September 2, 1980

INVENTOR(S) : Thomas S. Dwan

It is certified that error appears in the above-identified patent and that said Letters Patent are hereby corrected as shown below:

Column 6, line 25, cancel "is" and substitute --in--;
line 52, cancel "step" and substitute --space--.

Signed and Sealed this

*Second* Day of *October 1984*

[SEAL]

*Attest:*

GERALD J. MOSSINGHOFF

*Attesting Officer*

*Commissioner of Patents and Trademarks*